US005495112A

United States Patent [19]

Maloney et al.

[11] Patent Number: 5,495,112

[45] Date of Patent: Feb. 27, 1996

[54] FLAME DETECTOR SELF DIAGNOSTIC SYSTEM EMPLOYING A MODULATED OPTICAL SIGNAL IN COMPOSITE WITH A FLAME DETECTION SIGNAL

[75] Inventors: Patrick D. Maloney, Mentor; Gregory H. Pruett, Parma; Taryl W. Vertal, Willoughby, all of Ohio

[73] Assignee: Elsag International N.V., Zuidoost, Netherlands

[21] Appl. No.: 359,072

[22] Filed: Dec. 19, 1994

[51] Int. Cl.[6] ..... G01J 5/10

[52] U.S. Cl. ..... 250/554; 340/578; 431/79

[58] Field of Search ..... 250/554; 356/43, 356/48; 340/506, 577, 578, 583; 431/79

[56] References Cited

U.S. PATENT DOCUMENTS

| | | | |
|---|---|---|---|
| 3,286,761 | 11/1966 | Engh | 431/79 |
| 3,391,984 | 7/1968 | Metcalf et al. | 431/79 |
| 3,609,382 | 9/1971 | Moore et al. | 250/554 |
| 4,322,723 | 3/1982 | Chase | 340/578 |
| 4,381,455 | 4/1983 | Komori | 250/554 |
| 4,692,750 | 9/1987 | Murakami et al. | 340/506 |
| 5,026,272 | 6/1991 | Takahashi et al. | 431/79 |
| 5,264,708 | 11/1993 | Hijikata | 250/554 |

*Primary Examiner*—Edward P. Westin
*Assistant Examiner*—Steven L. Nichols
*Attorney, Agent, or Firm*—Michael M. Rickin

[57] ABSTRACT

A self diagnostic system for a flame detector. The system produces an optical determinant signal from an analog determinant signal that has a controllable amplitude and frequency. The system detects the optical determinant signal and the optical signal from the flame and processes both signals to thereby continuously monitor the flame while also continuously analyzing the operating status of the flame detector.

14 Claims, 4 Drawing Sheets

FLAME DETECTOR SELF DIAGNOSTIC SYSTEM EMPLOYING A MODULATED OPTICAL SIGNAL IN COMPOSITE WITH A FLAME DETECTION SIGNAL

FIELD OF THE INVENTION

This invention relates to flame detectors and more particularly to a fully encompassing self diagnostic system for use therewith.

DESCRIPTION OF THE PRIOR ART

Flame detectors monitor combustion processes for the presence or absence of flame within each part of the process and/or within the system as a whole. As is well known, the optical signal generated from the flame is made up of multiple wavelength components. Corresponding to the multiplicity of wavelengths there exists a "pulsation" or "flicker" frequency of the light from the combustion. These frequencies are typical of those found in vibrations of mechanical systems. Each of these frequency components has its own magnitude. The combination of these frequency components and their relative magnitude to the background and to each other gives rise to the frequency characteristics of the signal representative of the flame.

The flame signal contains information about the flame. The bulk of the information is contained within a specific frequency range which is characteristic of the flame itself. It is that frequency range which a class of flame detectors monitor to determine the existence or nonexistence of the flame.

The safety and efficient operation of the combustion process relies partly on the ability of the flame detector to detect the presence or absence of flame while fuel is being fed to the burner. In the event combustion is not present, and it is not detected, excessive fuel build-up can occur causing an unsafe condition. For this reason, it is important to place some level of confidence in the operation of the flame detector. Therefore, flame detectors have included self diagnostic or checking systems for such a purpose.

One well known prior art self checking system uses an arrangement whereby a mechanical shutter is placed between the flame and the sensor. The shutter is periodically opened and closed. Each time the shutter is closed the monitoring of the flame by the detector is interrupted. Flame detectors, such as those that use a mechanical shutter, are limited to self checking arrangements that are non-continuous in their modulation scheme, provide a level of confidence based on the last tested event (i.e., shutter opened), periodically interrupt the monitoring process and/or provide only binary schemes with go and no go conditions. A flame detector of the mechanical shutter type does not provide information as to the cause for the occurrence of a no go condition. Such a condition may occur either from an absence of flame or a fault in the detector.

It is desirable to have a self-checking system that provides a level of confidence in the flame detector by continuously analyzing the operating status of the flame detector while simultaneously allowing the flame detector to continuously monitor the flame. Further, it is desirable to have a self checking system that provides more than the binary scheme of go and no go, such as determining if a no go condition is due to the absence of flame or a fault in the flame detector. The self checking system of the present invention continuously analyzes the operating status of the detector while simultaneously allowing the detector to monitor the flame and determines if the no go condition is due to an absence of flame or a fault in the detector.

SUMMARY OF THE INVENTION

A self diagnostic system for a detector that detects an optical signal from a flame. The system has a controllable analog signal generator that generates an analog determinant signal that has a predetermined amplitude and frequency. The generator is controlled to thereby vary the analog determinant signal predetermined amplitude and frequency. The system also has a converter that converts the analog determinant signal into an optical determinant signal. The system further has apparatus that detects the optical determinant signal and the optical flame signal and converts the detected optical signals to an analog signal having a component representative of the detected optical flame signal and a component representative of the detected optical determinant signal.

The system further has apparatus that responds to the analog signal component representative of the detected optical flame signal to generate an analog signal representative of the detected flame amplitude and frequency. The system also further has apparatus that responds to the analog signal component representative of the detected optical determinant signal to generate a set of data representative of the spectrum of the detected determinant signal.

The system further has apparatus that responds to the detected flame amplitude and frequency representative analog signal and the spectrum set of data to control:

i. the analog determinant signal generator to vary the analog determinant signal predetermined amplitude when either the detected optical determinant signal amplitude is not greater than the detected optical flame signal analog signal amplitude at the determinant signal frequency by a first predetermined amount or the detected optical determinant signal amplitude is not less than the peak of said detected optical flame signal analog signal amplitude by a second predetermined amount, and ii. the analog determinant signal generator to vary the analog determinant signal predetermined frequency when both the detected optical determinant signal amplitude is not greater than the detected optical flame signal analog signal amplitude at the determinant signal frequency by the first predetermined amount and the detected optical determinant signal amplitude is not less than the peak of said detected optical flame signal analog signal amplitude by the second predetermined amount.

A self diagnostic method for a detector that detects an optical signal from a flame. The method generates an analog determinant signal with has a predetermined amplitude and frequency. The analog determinant signal is controllable to thereby vary the analog determinant signal predetermined amplitude and frequency. The method then converts the analog determinant signal into an optical determinant signal. The system then detects the optical determinant signal and the optical flame signal and converts the detected optical signals to an analog signal having a component representative of the detected optical flame signal and a component representative of the detected optical determinant signal.

The method then generates in response to the analog signal component representative of the detected optical flame signal an analog signal representative of the detected optical flame signal amplitude and frequency. The method then generates in response to the analog signal component representative of the detected optical determinant signal a set of data representative of the spectrum of the detected optical determinant signal.

The method then responds to the detected optical flame signal amplitude and frequency representative analog signal and the spectrum set of data to control:

i. the controllable analog determinant signal to vary the analog determinant signal predetermined amplitude when either the detected optical determinant signal amplitude is not greater than the detected optical flame signal analog signal amplitude at the determinant signal frequency by a first predetermined amount or the detected optical determinant signal amplitude is not less than the peak of said detected optical flame signal analog signal amplitude by a second predetermined amount, and ii. the controllable analog determinant signal to vary the analog determinant signal predetermined frequency when both the detected optical determinant signal amplitude is not greater than the detected optical flame signal analog signal amplitude at the determinant signal frequency by the first predetermined amount and the detected optical determinant signal amplitude is not less than the peak of said detected optical flame signal analog signal amplitude by the second predetermined amount.

DESCRIPTION OF THE PREFERRED EMBODIMENTS

Figure 1:
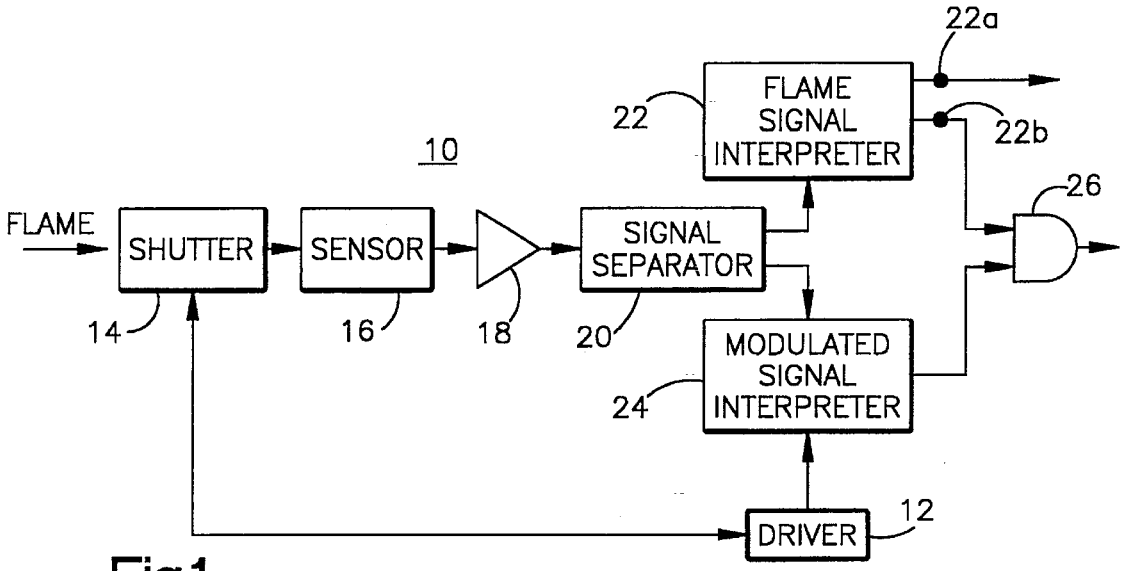
Fig.1 (PRIOR ART)
FIG. 1 shows a simplified block diagram of an embodiment for a prior art self checking system of the mechanical shutter type.

Referring now to FIG. 1, there is shown a simplified block diagram of an embodiment for a prior art self checking system 10 of the mechanical shutter type. System 10 comprises a fixed frequency driver 12 that periodically opens and closes the shutter 14 resulting in a modulated optical signal appearing at a sensor 16. The shutter is normally open and driver 12 closes the shutter only for a short interval of time.

Figure 1A:
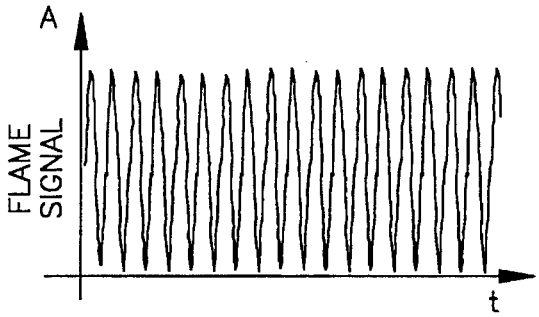
FIGS. 1*a* and 1*b* show, respectively, the time domain and frequency domain flame signal for the embodiment of FIG. 1.
Figure 1B:
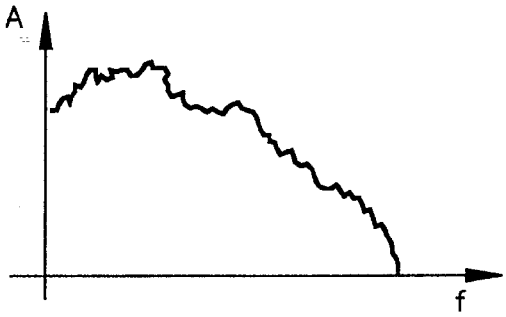
Figure 1C:
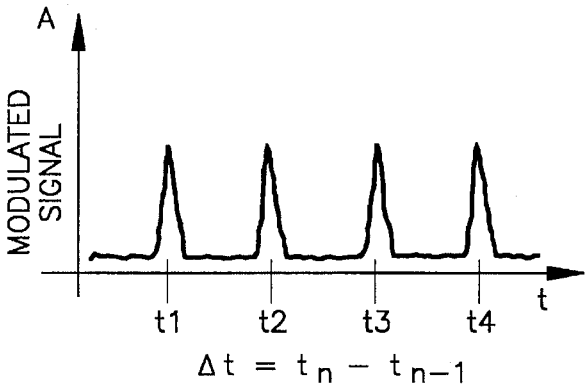
FIGS. 1*c* and 1*d* show, respectively, the time domain and frequency domain modulated signal for the embodiment of FIG. 1.
Figure 1D:
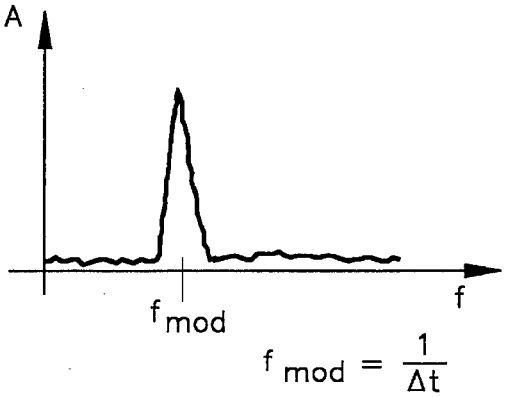

The sensor 16 converts the optical signal into an electrical signal which is amplified by amplifier 18. The amplified signal is separated by signal separator 20 into a flame signal and a modulated signal. The flame signal is shown in FIG. 1*a* for the time domain and in FIG. 1*b* for the frequency domain. The modulated signal is shown in FIG. 1*c* for the time domain and in FIG. 1*d* for the frequency domain.

The flame signal is interpreted by flame signal interpreter 22. The interpreter 22, may for example, look at the peak brightness of the flame signal within a predetermined flame flicker signal frequency band and provide at output 22*a* an analog signal in the form of a voltage or a current whose amplitude is representative of the peak brightness. In addition, interpreter 22 also determines if the amplitude of the analog signal is above or below a predetermined amplitude, which is representative of the presence or absence of flame, respectively, and provides at output 22*b* a binary signal representative thereof. The binary signal at output 22*b* is connected to one input of two input AND gate 26.

The modulated signal is interpreted by interpreter 24 which also has an input from driver 12. The input from driver 12 is used by interpreter 24 to demodulate the modulated signal. The interpreter 24 provides at its output, which is connected to the other input of gate 26, a binary signal representative of the open or closed condition of shutter 14. The output of gate 26 is connected to logic (not shown) which determines if the flame detector has failed.

When the shutter 14 is open, the modulated signal interpreter 24 arms the gate 26 by sending out the appropriate binary signal. If, with the shutter open, the flame signal interpreter 22 assesses that a valid flame signal does not exist, then the binary signal at output 22*b* allows the gate 26 to provide a digital signal to the logic that is indicative of a faulty flame detector or a no go condition. When the shutter is closed the amplitude of the flame signal may be such that interpreter 22 will provide at output 22*b* a binary signal that indicates that the flame detector has failed. Such an indication is false as the shutter is closed and should not be provided to the failed flame detector logic. With the shutter closed the output of interpreter 24 disarms the gate 26 to thereby prevent such an occurrence.

Figure 2:
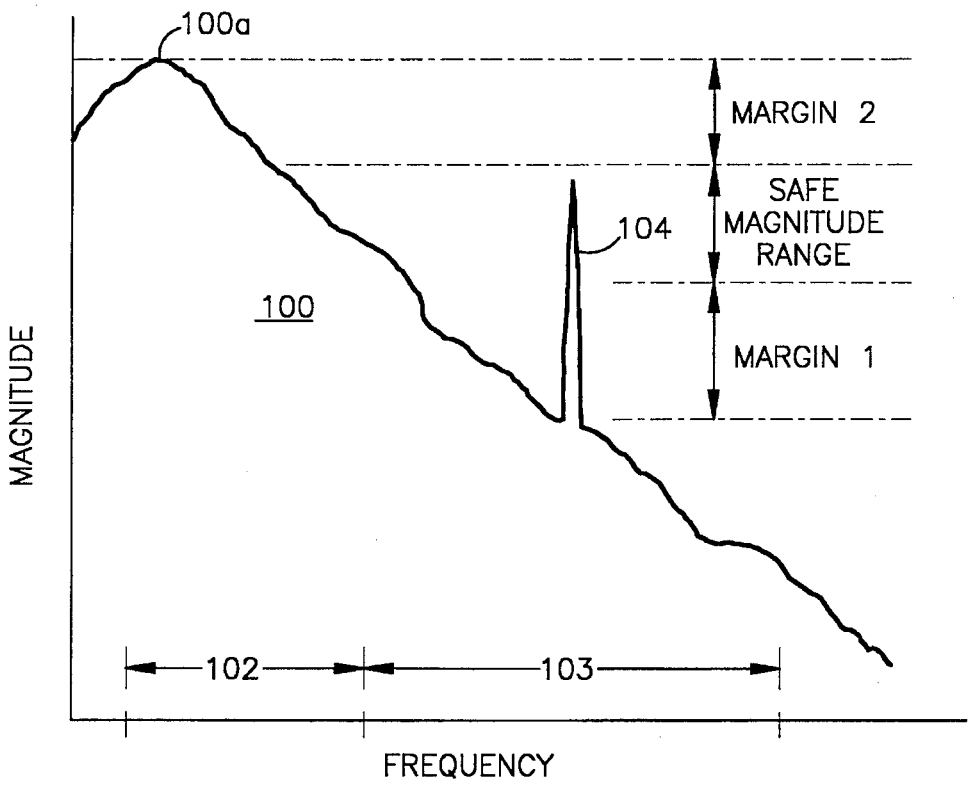
FIG. 2 shows the magnitude versus frequency characteristic of a flame signal including the determinant signal of the present invention where that determinant signal falls within the safe magnitude range.

Referring now to FIG. 2, there is shown the magnitude versus frequency characteristic 100 of a flame signal. The flame signal 100 contains information about the flame and the bulk of this information is contained within a specific frequency range 102 that is characteristic of the process. As was described in connection with FIG. 1, a flame detector monitors the frequency range 102 to determine the quality or integrity of the flame.

In accordance with the self diagnostic system of the present invention, a determinant signal 104 is superimposed on flame signal 100. As will be described in more detail hereinafter, the determinant signal is superimposed on the flame signal at the same sensor/transducer that is used to sense the flame signal. The same methods that are used by the flame detection system to analyze the flame signal 100 are also used to analyze and control the determinant signal 104 to thereby ensure the integrity of the flame detection system. If the flame detection system cannot verify the presence of the determinant signal, then a failure has occurred in some part of that system.

The magnitude and frequency of the determinant signal 104 are governed by specific parameters of the flame signal 100. The frequency selected for the determinant signal cannot be within the frequency range 102 monitored by the flame detection system for the flame signal. Complex information at the frequency selected for the determinant signal would result if that should occur. Therefore, the determinant signal frequency must lie within a range of frequencies 103 that is located away from the monitored frequency range 102 of the flame signal.

In order for the determinant signal magnitude to be visible that magnitude must be greater by a first predetermined amount or margin than the magnitude of the flame signal 100 over the frequency range of the determinant signal. This first predetermined margin is indicated in FIG. 2 as Margin 1.

The determinant signal magnitude must also be less than the peak magnitude 100*a* of the flame signal by a second predetermined amount or margin. This second predetermined margin is indicated in FIG. 2 as Margin 2. The requirement imposed by Margin 2 allows the full dynamic range of the flame signal to be used by the flame detection system to thereby obtain the highest resolution possible from the system for that signal. Therefore, Margin 2 ensures that the self checking system does not impede the flame detection system from performing its primary function of analyzing the flame.

The desired operating range of the self diagnostic system of the present invention is above Margin 1 and below Margin 2. This desired operating range is indicated in FIG. 2 as the "Safe Magnitude Range". Therefore, as will be described in more detail below, the self diagnostic system increases the determinant signal magnitude if it falls below Margin 1 and decreases the determinant signal magnitude if it rises above Margin 2.

Figure 2A:
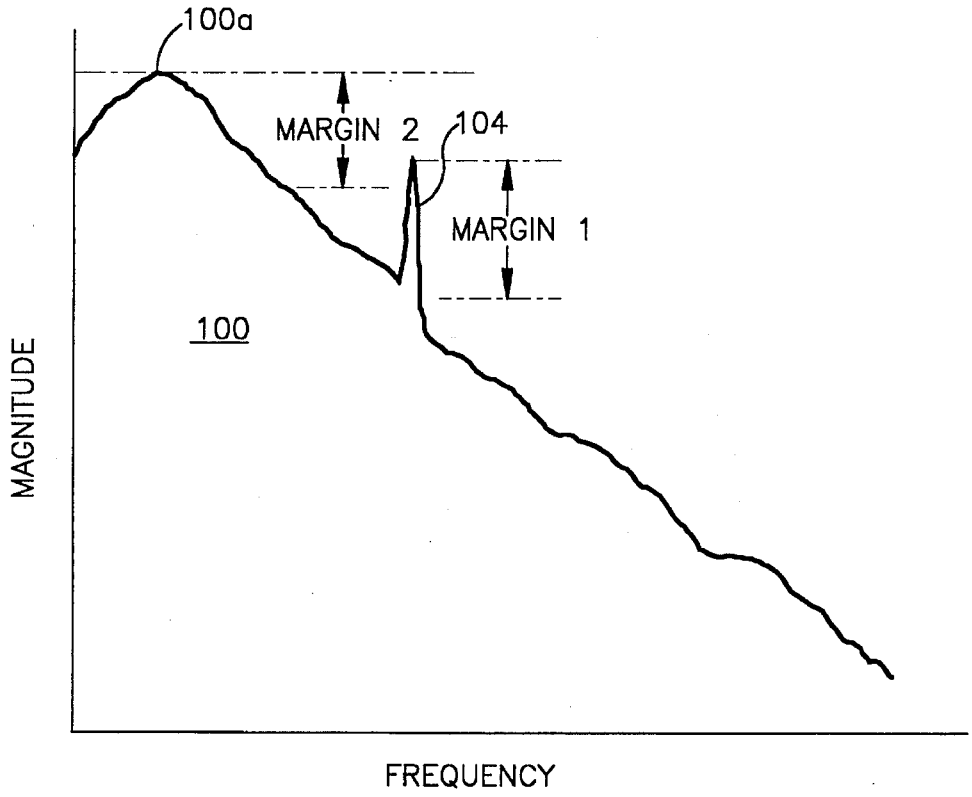
FIG. 2*a* shows the characteristic of FIG. 2 wherein the frequency selected for the determinant signal causes Margin 1 and Margin 2 to overlap.

As is shown in FIG. 2*a*, the frequency initially chosen for the determinant signal 104 may cause Margin 1 and Margin 2 to overlap. Therefore, there isn't a Safe Magnitude Range associated with determinant signal 104 of FIG. 2*a* and a new frequency must be found for the determinant signal that allows for a Safe Magnitude Range. In order to find such a frequency the self diagnostic system of the present invention will, in the manner to be described below, make a large change in frequency for the determinant signal from the frequency initially selected for the determinant signal. A large change in determinant signal frequency ensures that a frequency will be quickly found for the determinant signal wherein its determinant signal magnitude falls within the Safe Magnitude Range.

The frequency initially chosen for the determinant signal 104 may cause the driver that is providing the determinant signal to exceed acceptable power limits in order for the determinant signal to have a magnitude that exceeds Margin 1. Therefore, a new frequency must be found for the determinant signal that allows the signal to have a magnitude that exceeds Margin 1 and the driver not to exceed acceptable power limits. In order to find such a frequency the self diagnostic system of the present invention will, in the manner to be described below, make a large change in frequency for the determinant signal from the frequency initially selected for the determinant signal. A large change in determinant signal frequency ensures that a frequency will be quickly found for the determinant signal wherein its magnitude exceeds Margin 1 and the driver has acceptable power limits.

It should be appreciated that the self diagnostic system of the present invention must also test to determine if the amplitude detected by it for the determinant signal is or is not due to noise. The noise may or may not have existed when the determinant signal was tested to determine if it met the various criteria described above. The test performed by the system in order to determine if the detected amplitude is due to noise and the response of the system if it finds that to be so will be described in detail below.

Figure 3:
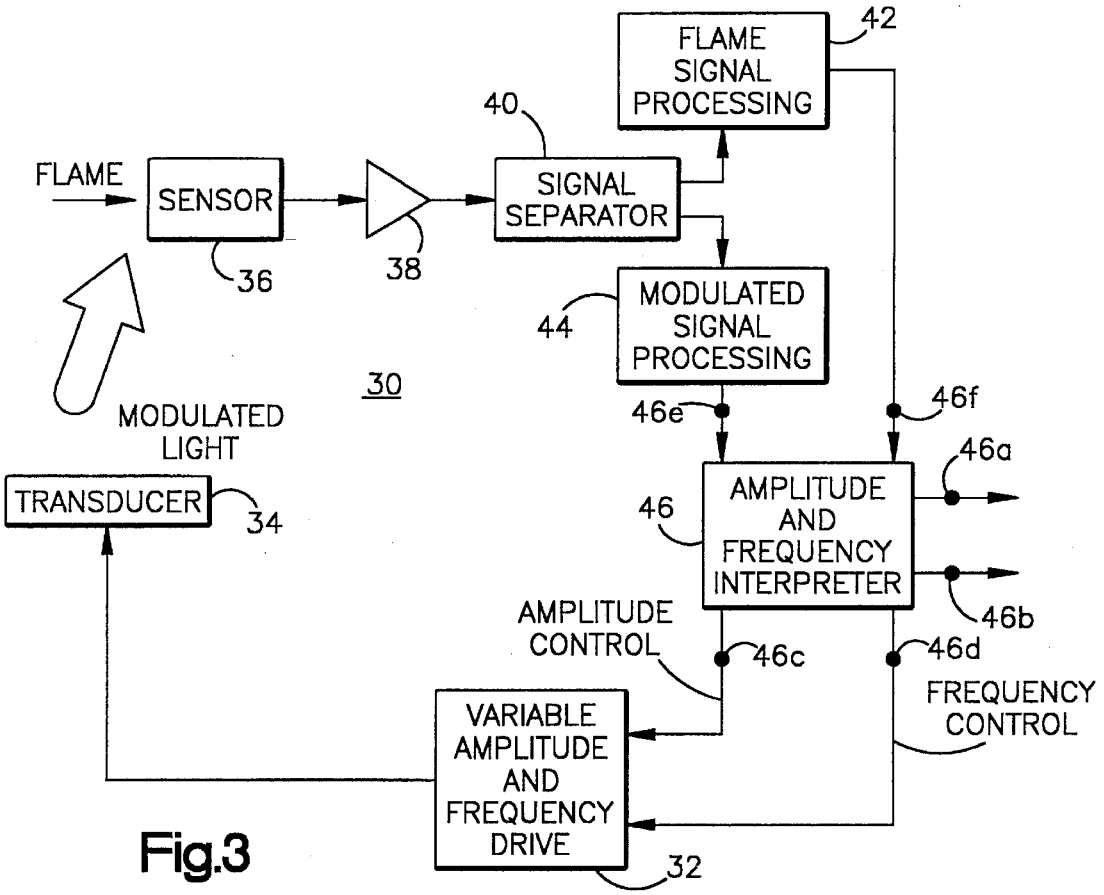
FIG. 3 shows a block diagram for a flame detecting system wherein the self diagnostic system of the present invention may be used.

Referring now to FIG. 3, there is shown a block diagram of the flame detecting system 30 wherein the self diagnostic system of the present invention may be used. System 30 includes variable amplitude and frequency driver 32 that generates the analog electrical determinant signal. Transducer 34, which may for example be a light emitting diode (LED), converts the analog electrical determinant signal to a modulated optical signal. Sensor 36 receives an optical signal that is the combination of the optical flame signal from the combustion process and the modulated optical determinant signal.

As in the prior art system 10, sensor 36 converts the optical signals at its input into an analog electrical signal which is amplified by amplifier 38. As in the prior art system 10, the amplified analog electrical signal is separated by a signal separator 40 into a flame signal and a modulated signal which is representative of the determinant signal. The flame signal and the modulated signal are then analyzed by using digital signal processing techniques which are represented in FIG. 3 by flame signal processor 42 and modulated signal processor 44. While FIG. 3 shows the flame signal processing separate and apart from the modulated signal processing, it should be appreciated that the present invention uses the same signal processing techniques to analyze both signals. One implementation for the signal processing techniques will be described in more detail below in connection with FIG. 4.

The outputs of flame signal processor 42 and modulated signal processor 44 are analog signals. The analog signal at the output of flame signal processor 42 are the characteristic signals which identify the values and relationships of the flame amplitude and frequency. The analog signal at the output of modulated signal processor 44 are the characteristic signals which identify the values and relationships of the superimposed modulated determinant signal amplitude and frequency.

The analog signals at the outputs of processors 42 and 44 are inputs to amplitude and frequency interpreter 46. Interpreter 46 has four outputs 46*a*, 46*b*, 46*c* and 46*d*. Output 46*a* is an analog signal which is representative of the qualitative level of the flame, i.e., the flame is, for example, 10% or 50% or 100% of its maximum level. The maximum level is determined by the application in which the flame detector is used. Output 46*b* is a logic signal that is used by logic (not shown) to determine if there is a go or no go flame determination from the detector in which the self diagnostic system of the present invention is being used.

The signals at the outputs 46*c* and 46*d* are inputs to variable amplitude and frequency driver 32. Output 46*c* is an amplitude control signal which is used to control, in the manner to be described below in connection with FIG. 5, the amplitude of the modulated signal provided by driver 32 to transducer 34. Output 46*d* is a frequency control signal which is used to control, in the manner to be described below in connection with FIG. 5, the frequency of the modulated signal provided by driver 32 to transducer 34.

Figure 4:
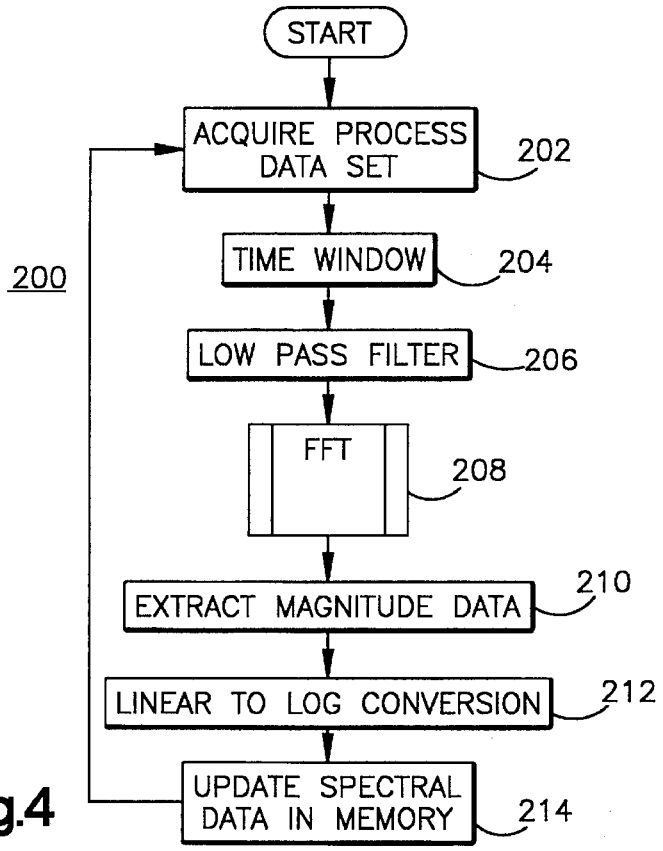
FIG. 4 shows a simplified flow diagram for the steps to be performed in a microprocessor implementing the flame signal processing and modulated signal processing of FIG. 3.

Referring now to FIG. 4, there is shown a simplified flow diagram 200 of the steps performed by a digital signal processor microprocessor (not shown) which may be used to implement the signal processing technique used in modulated signal processor 44. While the flow diagram of FIG. 4 will be described with respect to the modulated signal processor 44, it should be appreciated that the same signal processing technique is used in flame signal processor 42. Each of the steps shown in the flow diagram may, as is well known to those skilled in the art, be made up of a number of instructions.

In step 202 the flame signal is sampled to provide a discrete time domain data set which is comprised of a predetermined number of points, for example, 256, which is stored in a memory (not shown). In step 204 a time window is applied to the data set acquired in step 202. The time window is used to reduce the magnitude of the higher order frequency components that are introduced by truncating a sample data set. As is well known to those skilled in the art, there are many types of time windows such as Gaussian, Blackman, Cosine, Rectangle and Hamming just to name a few. As is also well known to those skilled in the art, the time window will reduce the amplitude of the sidelobes in the frequency domain plot that results when a Fourier transform is applied to a finite sample data set.

In step 206 a low pass filter is used to bandwidth limit the time domain signal. In step 208 a fast Fourier transform is used to take the Fourier transform of the low pass filtered time domain signal to thereby convert the time domain data to frequency domain data. In step 210 the linear magnitude data is extracted from the Fourier transformed time domain signal. A technique such as the square root of the sum of the squares may be used to extract the linear magnitude data.

In step 212 the linear magnitude data values extracted in step 210 are converted to logarithmic data values. In step 214 the buffer in the memory that is used to store the frequency domain data that is used by the self diagnostic system of the present invention is updated with the logarithmic data values determined in step 212.

Figure 5:
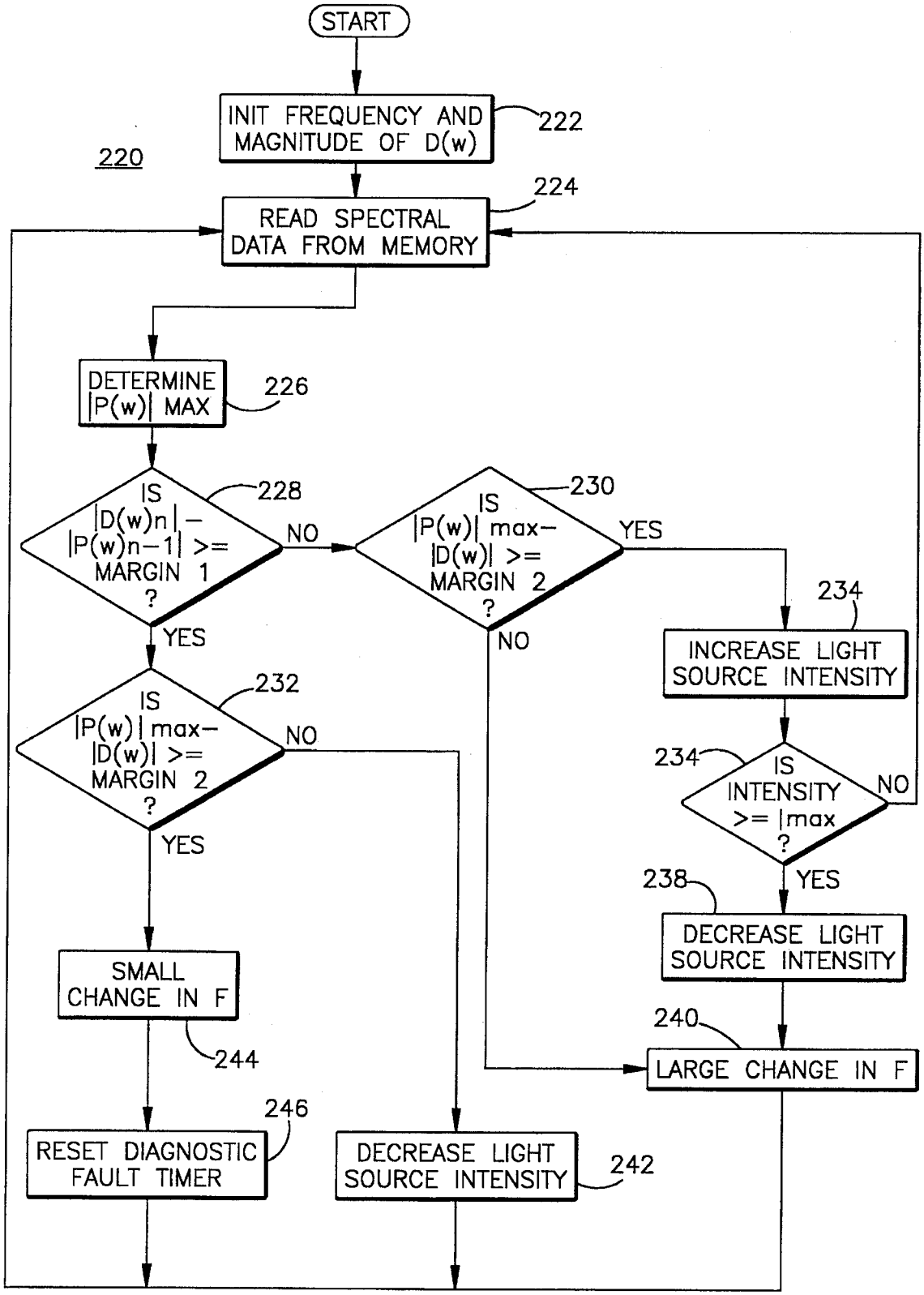
FIG. 5 shows a simplified flow diagram of the steps to be performed in a microprocessor implementing the amplitude and frequency interpreter of FIG. 3.

Referring now to FIG. 5, there is shown a simplified flow diagram 220 of the steps performed by a microprocessor and a digital signal processor microprocessor (not shown) which may be used to implement the amplitude and frequency interpreter 46. Interpreter 46 has inputs 460 and 46*f*. The logarithmic data values that were stored in step 214 of FIG. 4 are received at input 46*e*. The analog output signal of flame signal processor 42 is received at input 46*f*. As was described above, interpreter 46 uses the input signals to among other things provide at outputs 46*c* and 46*d* the signals which are to control the amplitude and frequency of the modulated signal provided by driver 32.

In step 222 the initial amplitude and frequency of the determinant signal 104 is determined. If the self diagnostic system has not been previously running the amplitude and frequency are set to a predetermined amplitude and frequency. If the self diagnostic system is running then the values for the initial frequency and amplitude of signal 104 are those that exist at the beginning of the present operating cycle of the routine set forth in flowchart 220.

As was described above in connection with FIG. 3, the self diagnostic system of the present invention determines if the amplitude and frequency of signal 104 meets the criteria of falling within the Safe Magnitude Range and not causing the driver 32 to exceed acceptable power limits. These determinations are made by the steps in flow diagram 220. If the initial amplitude and frequency selected for signal 104 is such that the signal does not meet either or both criteria the amplitude or frequency is adjusted in a direction so as to cause the criteria to be met.

In step 224 the logarithmic data values that were stored in step 214 of FIG. 4 are read by the diagnostic control algorithm. In step 226 the data values are sorted to find the frequency component that has the largest magnitude. That component corresponds to magnitude 100*a* of FIGS. 2 and 2*a*. The routine then proceeds to a series of steps wherein it asks the questions:

1. does the amplitude of the determinant signal satisfy the Margin 1 criteria?; and,
2. does the amplitude of the determinant signal satisfy the Margin 2 criteria?

The first question is asked in step 228 wherein it is determined if the difference between the absolute value of the amplitude of the signal 104 and the absolute value of the magnitude of the adjacent frequency component in the data set stored in step 214 of FIG. 4 is greater than or equal to Margin 1. The second question is asked either in step 230 if the answer in step 228 is no, or in step 232 if the answer in step 228 is yes. In steps 230 and 232 it is determined if the difference between the peak magnitude of the process signal determined in step 226 and the magnitude of the determinant signal 104 is greater than or equal to Margin 2.

A yes answer in step 230 allows the intensity of the light from transducer 34 to be increased to thereby raise the amplitude of the signal 104. That increase in amplitude should cause the answer to the question asked in step 228 to be yes in the next cycle of operation of the routine. In other words, step 228 has determined that the amplitude of the signal 104 is not high enough as it does not exceed Margin 1 and step 230 has determined that the amplitude is not so high as to exceed Margin 2, thereby allowing the amplitude of the signal 104 to be increased. That increase in amplitude is provided by step 234 which changes the amplitude of the amplitude control signal at output 46*c* to thereby cause the driver 32 to drive the transducer 34 to provide more light.

The routine then proceeds to step 236 wherein it determines if the increase in amplitude of light to be provided by transducer 34 in response to step 234 will exceed the rating of the transducer. If the transducer is a LED, the rating is the rated current limit of the LED. If the answer in step 236 is no, the routine then returns to step 224 to begin its next cycle. If the answer in step 236 is yes, then the amplitude of the light provided by transducer 34 must be decreased. That decrease in amplitude is provided by step 238.

The routine then proceeds to step 240. This step, as described directly above, may be reached from step 238 if the routine has determined that the increase in amplitude of light to be provided by the transducer will exceed the rating of the transducer. Step 240 may also be reached if the answer in step 230 is no, i.e., the amplitude of the determinant signal 104 is such that the Margin 2 criteria is exceeded. It should be appreciated that in order for the routine to reach step 230, the answer in step 228 must be a no, i.e., the amplitude of the determinant signal does not meet the Margin 1 criteria. A answer of no in steps 228 and 230 is an indication that Margin 1 and Margin 2 overlap as is shown in FIG. 2*a*.

In either instance described above of reaching step 240 that step must change the frequency of the signal 104 by a relatively large amount. As was described previously, a relatively large change in frequency ensures that a frequency will quickly be found for the determinant signal wherein either its magnitude falls within the Safe Magnitude Range if step 240 was reached through an answer of no in both steps 228 and 230 or its magnitude exceeds Margin 1 and the driver has acceptable power limits if step 240 was reached from step 238.

This relatively large change in frequency is obtained by having a series which has a predetermined number of large step changes in frequency. If the series is not at its last step change in frequency, step 240 increases the frequency of signal 104 by proceeding to the next step of the series. If the series is at its last step change in frequency, step 240 returns the frequency to the first step change in frequency in the series. The routine then returns to step 224 to begin its next cycle.

Returning now to step 228, if the answer to the question asked therein is yes the Margin 1 criteria is satisfied and the routine proceeds to step 232. If the answer in step 232 is no, the Margin 2 criteria has not been satisfied and the amplitude of the determinant signal 104 is too high and must be decreased. That decrease in amplitude is provided by step 242 which changes the amplitude of the amplitude control signal at output 46*c* to thereby cause the driver 32 to drive the transducer 34 to provide less light.

If the answer in step 232 is yes, the determinant signal amplitude has satisfied both the Margin 1 criteria (step 228) and the Margin 2 criteria (step 232). The routine then proceeds to step 244 wherein the frequency of the signal 104 is changed by a relatively small amount to verify the integrity of the signal to thereby ensure that the detected signal is not due to noise. This small change in frequency is not absolutely necessary as the determinant signal amplitude in the present cycle has satisfied the Margin 1 and Margin 2 criteria.

The relatively small change in frequency is obtained by having a series which has a predetermined number of small step changes in frequency. If the series is not at its last step change in frequency, step 244 increases the frequency of signal 104 by proceeding to the next step of the series. If the series is at its last step change in frequency, step 244 returns the frequency to the first step change in frequency in the series.

The routine then proceeds to step 246 wherein the diagnostic fault timer is reset because the detected determinant signal has in this cycle of the routine meet all of the criteria. The timer is set to count for a predetermined number of cycles and the failure to reset the timer before the end of the predetermined number of cycles indicates that there is a problem with the self diagnostic system. The routine then returns to step 224 to begin its next cycle.

It should be appreciated that the signal detected during a cycle as the determinant signal may actually be the result of noise. Shifting the frequency of the determinant signal by a relatively small change in frequency at the end of each cycle allows the system of the present invention to determine if the detected signal is due to noise or is the determinant signal as the frequency of the determinant signal resulting from the shift in frequency is known and for any instant of time the noise usually appears at only one frequency.

It is to be understood that the description of the preferred embodiment(s) is (are) intended to be only illustrative, rather than exhaustive, of the present invention. Those of ordinary skill will be able to make certain additions, deletions, and/or modifications to the embodiment(s) of the disclosed subject matter without departing from the spirit of the invention or its scope, as defined by the appended claims.

What is claimed is:

1. A self diagnostic system for a detector that detects an optical signal from a flame, comprising:

a) means for generating an analog determinant signal having a predetermined amplitude and frequency, said means controllable for varying said analog determinant signal predetermined amplitude and frequency;

b) means for converting said analog determinant signal into an optical determinant signal;

c) means for detecting said optical determinant signal and said optical flame signal and converting said detected optical signals to an analog signal having a component representative of said detected optical flame signal and a component representative of said detected optical determinant signal;

d) means responsive to said analog signal component representative of said detected optical flame signal for generating an analog signal representative of said detected optical flame signal amplitude and frequency;

e) means responsive to said analog signal component representative of said detected optical determinant signal for generating a set of data representative of the spectrum of said detected optical determinant signal; and f) means responsive to said detected optical flame signal amplitude and frequency representative analog signal and said spectrum set of data for controlling:

i. said analog determinant signal generating means to vary said analog determinant signal predetermined amplitude when either said detected optical determinant signal analog signal amplitude is not greater than said detected optical flame signal analog signal amplitude at said determinant signal frequency by a first predetermined amount or said detected optical determinant signal analog signal amplitude is not less than the peak of said detected optical flame signal analog signal amplitude by a second predetermined amount, and ii. said analog determinant signal generating means to vary said analog determinant signal predetermined frequency when both said detected optical determinant signal analog signal amplitude is not greater than said detected optical flame signal analog signal amplitude at said determinant signal frequency by said first predetermined amount and said detected optical determinant signal analog signal amplitude is not less than the peak of said detected optical flame signal analog signal amplitude by said second predetermined amount.

2. The self diagnostic system of claim 1 further comprising means for separating said analog signal into said component representative of said detected optical flame signal and said component representative of said detected optical determinant signal.

3. The self diagnostic system of claim 1 wherein said controlling means controls said analog determinant signal generating means to vary said analog determinant signal predetermined frequency by a first predetermined change in frequency when both said detected optical determinant signal analog signal amplitude is not greater than said detected optical flame signal analog signal amplitude at said determinant signal frequency by said first predetermined amount and said detected optical determinant signal analog signal amplitude is not less than the peak of said detected optical flame signal analog signal amplitude by said second predetermined amount.

4. The self diagnostic system of claim 3 wherein said controlling means is also responsive to said detected optical flame signal amplitude and frequency representative analog signal and said spectrum for controlling only said analog determinant signal generating means to vary said analog determinant signal predetermined frequency by a second predetermined change in frequency, which is less than said first predetermined change in frequency, when both said detected optical determinant signal analog signal amplitude is greater than said detected optical flame signal analog signal amplitude at said determinant signal frequency by said first predetermined amount and said detected optical determinant signal analog signal amplitude is less than the peak of said detected optical flame signal analog signal amplitude by said second predetermined amount.

5. The self diagnostic system of claim 1 wherein said controlling means controls said analog determinant signal generating means to decrease said analog determinant signal predetermined amplitude when said detected optical determinant signal analog signal amplitude is not less than the peak of said detected optical flame signal analog signal amplitude by said second predetermined amount.

6. The self diagnostic system of claim 1 wherein said controlling means controls said analog determinant signal generating means to increase said analog determinant signal predetermined amplitude when said detected optical determinant signal analog signal amplitude is not greater than said detected optical flame signal analog signal amplitude at said determinant signal frequency by said first predetermined amount.

7. The self diagnostic system of claim 6 further comprising means for determining if said increase of said analog determinant signal predetermined amplitude causes said means for converting said analog determinant signal into said optical determinant signal to exceed a predetermined rating of said converting means and means for decreasing said analog determinant signal predetermined amplitude if said increase causes said converting means to exceed said predetermined rating.

8. A self diagnostic method for a detector that detects an optical signal from a flame, said method comprising the steps of:

a) generating an analog determinant signal with a predetermined amplitude and frequency, said signal controllable for varying said analog determinant signal predetermined amplitude and frequency;

b) converting said analog determinant signal into an optical determinant signal;

c) detecting said optical determinant signal and said optical flame signal and converting said detected optical signals to an analog signal having a component representative of said detected optical flame signal and a component representative of said detected optical determinant signal;

d) generating in response to said analog signal component representative of said detected optical flame signal an analog signal representative of said detected optical flame signal amplitude and frequency;

e) generating in response to said analog signal component representative of said detected optical determinant signal a set of data representative of the spectrum of said detected optical determinant signal; and f) controlling in response to said detected optical flame signal amplitude and frequency representative analog signal and said spectrum set of data:

i. said controllable analog determinant signal to vary said analog determinant signal predetermined amplitude when either said detected optical determinant signal analog signal amplitude is not greater than said detected optical flame signal analog signal amplitude at said determinant signal frequency by a first predetermined amount or said detected optical determinant signal analog signal amplitude is not less than the peak of said detected optical flame signal analog signal amplitude by a second predetermined amount, and ii. said controllable analog determinant signal to vary said analog determinant signal predetermined frequency when both said detected optical determinant signal analog signal amplitude is not greater than said detected optical flame signal analog signal amplitude at said determinant signal frequency by said first predetermined amount and said detected optical determinant signal analog signal amplitude is not less than the peak of said detected optical flame signal analog signal amplitude by said second predetermined amount.

9. The method of claim 8 further comprising the step of separating said analog signal into said component representative of said detected optical flame signal and said component representative of said detected optical determinant signal.

10. The method of claim 8 wherein said step of controlling said controllable analog determinant signal to vary said analog determinant signal predetermined frequency when both said detected optical determinant signal analog signal amplitude is not greater than said detected optical flame signal analog signal amplitude at said determinant signal frequency by said first predetermined amount and said detected optical determinant signal analog signal amplitude is not less than the peak of said detected optical flame signal analog signal amplitude by said second predetermined amount controls said controllable analog determinant signal to vary said analog determinant signal predetermined frequency by a first predetermined change in frequency.

11. The method of claim 10 wherein said controlling step is also responsive to said detected optical flame signal amplitude and frequency representative analog signal and said spectrum for controlling only said controllable analog determinant signal to vary said analog determinant signal predetermined frequency by a second predetermined change in frequency, which is less than said first predetermined change in frequency, when both said detected optical determinant signal analog signal amplitude is greater than said detected optical flame signal analog signal amplitude at said determinant signal frequency by said first predetermined amount and said detected optical determinant signal analog signal amplitude is less than the peak of said detected optical flame signal analog signal amplitude by said second predetermined amount.

12. The method of claim 8 wherein said controlling step controls said controllable analog determinant signal to decrease said analog determinant signal predetermined amplitude when said detected optical determinant signal analog signal amplitude is not less than the peak of said detected optical flame signal analog signal amplitude by said second predetermined amount.

13. The method of claim 8 wherein said controlling step controls said controllable analog determinant signal to increase said analog determinant signal predetermined amplitude when said detected optical determinant signal analog signal amplitude is not greater than said detected optical flame signal analog signal amplitude at said determinant signal frequency by said first predetermined amount.

14. The method of claim 13 wherein further comprising a step of determining if said increase of said analog determinant signal predetermined amplitude causes said step for converting said analog determinant signal into said optical determinant signal to exceed a predetermined rating and a step for decreasing said analog determinant signal predetermined amplitude if said increase causes said converting step to exceed said predetermined rating.

* * * * *